United States Patent [19]

Miwa et al.

[11] 4,083,749

[45] Apr. 11, 1978

[54] METHOD OF MAKING SIZED PAPER

[75] Inventors: Tatsuro Miwa, Mitaka; Akira Aoyama, Kitamoto; Masatoshi Shimosaka, Tokyo; Hideto Kusumoto, Machida; Katsuhiko Kuroda, Yokohama, all of Japan

[73] Assignees: Mitsubishi Chemical Industries Ltd.; Hamano Industry Co., Ltd., both of Tokyo, Japan

[21] Appl. No.: 706,599

[22] Filed: Jul. 19, 1976

[30] Foreign Application Priority Data

Jul. 23, 1975 Japan ..... 50-89891

[51] Int. Cl.[2] ..... D21D 3/00

[52] U.S. Cl. ..... 162/168 N; 162/181 R; 162/181 A; 162/183; 162/184

[58] Field of Search ..... 162/183, 101, 181 A, 162/168 N, 168 R, 169, 78, 181 R, 184

[56] References Cited

U.S. PATENT DOCUMENTS

| | | | |
|---|---|---|---|
| 1,768,819 | 7/1930 | Bradley et al. | 162/78 |
| 1,795,757 | 3/1931 | Bradley et al. | 162/78 |
| 2,064,800 | 12/1936 | Kauffmann et al. | 162/101 |
| 2,613,579 | 10/1952 | McEwen | 162/78 |
| 3,291,679 | 12/1966 | O'Brien | 162/183 |
| 3,619,110 | 11/1971 | Borezee | 162/78 |

FOREIGN PATENT DOCUMENTS

| | | |
|---|---|---|
| 49-21245 | 5/1974 | Japan. |

OTHER PUBLICATIONS

Casey, "Pulp & Paper," vol. I, (1960), p. 456.

*Primary Examiner*—Richard V. Fisher
*Assistant Examiner*—Peter Chin
*Attorney, Agent, or Firm*—Oblon, Fisher, Spivak, McClelland & Maier

[57] ABSTRACT

An aqueous pulp slurry containing a cationic neutral sizing agent or a wet sheet prepared therefrom is treated with an oxidizing agent in a method of making a sized paper.

17 Claims, No Drawings

METHOD OF MAKING SIZED PAPER

BACKGROUND OF THE INVENTION

The present invention relates to a paper making method using a cationic neutral sizing agent.

More particularly, it relates to a method of improving a sizing effect of a cationic neutral sizing agent.

In the specification, the neutral sizing agent means a sizing agent which is used in acidic to neutral range (usually pH 4.5 to 8) in a paper making and can be used without a fixing agent. A cationic neutral sizing agent means the above defined neutral sizing agent having cationic component. A paper making method using a neutral sizing agent has been known. According to the conventional method, aluminum sulfate has not been used as a fixing agent whereby calcium carbonate can be used as a filler and a treatment of drainage has been easy. However, the neutral sizing agents have not been widely used because of disadvantages of unstable reproducibility of the sizing effect.

The inventors have studied on paper making methods using a cationic neutral sizing agent and have found that when a pulp slurry containing a sizing agent is treated with an oxidizing agent, the sizing effect has been remarkably improved and the stable sizing effect could be attained.

SUMMARY OF THE INVENTION

It is an object of the present invention to provide a paper making method wherein a stable sizing effect is highly imparted.

It is another object of the invention to provide a paper making method wherein a stable sizing effect is highly imparted and calcium carbonate can be used as a filler and a treatment of drainage is easy.

These objects of the present invention have been attained by treating an aqueous pulp slurry containing a cationic neutral sizing agent or a wet sheet prepared from the pulp slurry with an oxidizing agent.

DETAILED DESCRIPTION OF THE PREFERRED EMBODIMENTS

The paper making method of the invention can be carried out by using various cationic neutral sizing agents which are commercially available. Further, the method of the invention can be applicable to a neutral sizing agent prepared by emulsifying wax or petroleum resin with a cationic emulsifier. Typical cationic neutral sizing agents are prepared by reacting a hydrocarbon compound having acid anhydride group with a polyamine having at least one primary amino group and treating the product with an organic or inorganic acid to form an acidic salt or treating the product with a quaternizing agent to form quaternary compounds.

The cationic neutral sizing agents are water soluble or water dispersible. These cationic neutral sizing agents can be prepared by various methods. For example, the cationic neutral sizing agent can be prepared by copolymerizing α-olefin having more than 6 and up to 40 carbon atoms with maleic anhydride and reacting a diamine having one primary amino group with th resulting copolymer at a ratio of more than 0.4 mole per 1 mole of the acid anhydride group of the copolymer to obtain a diamine derivative of the copolymer and treating the diamine derivative of the copolymer with an acid to form acid salts. (Japanese Unexamined Patent Publication No. 70303/1976.)

It is preferable to use cationic neutral sizing agents which are prepared by reacting α-olefin having 10 to 30 of carbon atoms with maleic anhydride at a ratio of 1 to 1.5 mole of maleic anhydride per 1 mole of α-olefin to form a copolymer having an average molecular weight of 2,000 to 10,000 and reacting a diamine having a primary amino group and a tertiary amino group, preferably aliphatic diamines having a $C_{2-6}$ alkylene group such as N,N-dimethyl-1,3-propanediamine, N,N-diethyl-1,3-propanediamine, N,N-dimethylethylenediamine, N,N-diethyl-ethylenediamine at a ratio of 0.6 to 1.0 mole of the diamine per 1 mole of the acid anhydride group of the copolymer, and then treating the product with an acid to form acid salts. It is also possible to prepare cationic neutral sizing agents by reacting the α-olefin-maleic anhydride copolymer with 0.3 to 0.9 mole of a diamine having one primary amino group and 0.7 to 0.1 mole of urea per 1 mole of acid anhydride group of the copolymer to obtain a diamine-urea derivative of the copolymer and treating it with an acid to form acid salts. (Japanese Unexamined Patent Publication No. 70302/1976) In said case, it is preferable to use cationic neutral sizing agents which are prepared by reacting α-olefin having 10 – 30 carbon atoms with maleic anhydride at a ratio of 1 to 1.5 mole of maleic anhydride to 1 mole of α-olefin to obtain a copolymer having an average molecular weight of 2,000 to 10,000 and reacting the copolymer with 0.6 to 0.8 mole of a diamine having a primary amino group and a tertiary amino group, preferably aliphatic diamines having a $C_{2-6}$ alkylene group such as N,N-dimethyl-1,3-propanediamine, N,N-diethyl-1,3-propanediamine, N,N-dimethylethylenediamine, N,N-diethyl-ethylenediamine and 0.4 to 0.2 mole of urea per 1 mole of acid anhydride group of the copolymer and then treating the product with an acid to form acid salts.

It is considered that the imido bond is mainly formed and the semi-amido or amido bond is partially formed in the cationic neutral sizing agent by reacting the diamine and urea with acid anhydride group of the copolymer. In order to form acid salts from the diamine derivatives or the diamine-urea derivatives of the copolymers, an inorganic acid e.g. hydrochloric acid, sulfuric acid, boric acid, phosphoric acid, etc., and an organic acid e.g. formic acid, acetic acid, lactic acid, citric acid or a mixture thereof can be used.

It is also possible to form quaternary ammonium salts by treating the diamine derivatives or diamine-urea derivatives of the copolymers with a quaternizing agent instead of the treatment with acid.

The quaternizing agents can be (al) alkylhalide, (epi) halohydrine, dimethyl sulfate or the like.

It is also possible to prepare cationic neutral sizing agents by reacting petroleum resin with maleic anhydride to obtain maleic petroleum resin which is used instead of the α-olefin maleic anhydride copolymer and reacting it with the diamine or diamine-urea and then treating the product with an acid or a quaternizing agent to form acid salts or quaternary ammonium salts.

It is also possible to use cationic neutral sizing agents which are prepared by reacting α-olefin having 6 to 30 of carbon atoms with maleic anhydride to form alkenyl succinic acid and reacting it with a polyamine having a primary amino group and treating the product with an acid or a quaternizing agent to form acid salts or quaternary ammonium salts as same with the case of the copolymers. (Japanese Unexamined Patent Publication No. 1705/1976)

The polyamines used in the method can be aliphatic diamines having a $C_{2-6}$ alkylene group such as N,N-dimethyl-1,3-propanediamine, N,N-dimethylethylenediamine, N-methylethylenediamine, N-ethylethylenediamine, ethylenediamine, hexamethylenediamine; and aromatic diamines such as xylylenediamine, diaminotoluene; aliphatic diamines having hydroxyl group such as N-hydroxypropyl-1,3-propanediamine, N-hydroxyethylethylenediamine, N-hydroxypropylethylenediamine; heterocyclic diamines such as N-3-aminomethyl pyridine or the like. It is also possible to use polyamines having trivalent or more such as diethylenetriamine, iminobispropylamine, methyliminobispropylamine, triethylenetetramine, tetraethylenepentamine or the like. It is especially preferable to use the diamine such as ethylenediamine, xylylenediamine and the triamine such as diethylenetriamine, methyliminobispropylamine and the other polyamine such as triethylenetetramine, tetraethylenepentamine.

The polyamine is used at a ratio of 0.3 to 2 mole preferably 0.5 to 1.5 mole per 1 mole of the alkenyl succinic acid.

It is considered that the imido bond is mainly formed by reacting the polyamine with an alkenyl succinic acid, and semi-amido bond is partially formed.

The cationic neutral sizing agents having imido bond which is formed by reacting the carboxylic acid with the primary amine are water dispersible or water soluble depending upon the content of cationic nitrogen atom. In the method of the present invention, various cationic neutral sizing agents can be used and water soluble cationic neutral sizing agents are preferably used.

In the method of the invention, the paper making is carried out according to the conventional method except adding a step of treatment by an oxidizing agent.

It is preferable to treat the aqueous pulp slurry containing the cationic neutral sizing agent with the oxidizing agent.

In accordance with the typical paper making method of the invention, the cationic neutral sizing agent is added to the aqueous pulp slurry having a concentraton of 0.5 – 4 wt.%, usually 1 to 3 wt.% which is obtained from a beating step and then the oxidizing agent is added to the slurry and the slurry is diluted to a predetermined concentration to carry out the paper making.

An amount of the sizing agent to be added to the pulp slurry is dependent upon types of the paper to be prepared and is usually within the range of 0.5 – 5 wt.% preferably 1 – 3 wt.% to the pulp.

It is also possible to carry out the paper making by mixing the sizing agent with the slurry pulp, diluting the slurry with water and adding the oxidizing agent before paper making.

It is also possible to carry out the paper making by the conventional manner and treating a wet sheet with an aqueous solution of an oxidizing agent or a gas containing an oxidizing agent under the wet condition. It is possible to add the oxidizing agent to the aqueous pulp slurry together with the addition of the cationic neutral sizing agent. However, sometimes, the sizing effect is not effectively imparted by the method, and accordingly, it is preferable to add the oxidizing agent after the addition of the sizing agent.

The oxidizing agents can be halogen such as chlorine, bromine; halooxyacids such as chlorine dioxide, hypochlorous acid, chlorous acid, chloric acid, perchloric acid and salts thereof; heavy metal oxides such as potassium permanganate, potassium bichromate; ozone and the like.

When a heavy metal oxide is used, the heavy metal is built up in the drainage and a rather complicated treatment of the drainage is needed and sometimes paper obtained is colored. In case of using ozone, an ozonizer is used.

It is preferable to use chlorine, chlorine dioxide, chloroxyacids and salts thereof, such as sodium hypochlorite, bleaching powder or calcium hypochlorite [$Ca(OCl)_2$] as they are inexpensive and easy to handle and the cost of the total process is low.

The oxidizing agent is used at a ratio of more than equivalent, usually 1 to 100 equivalents to the cationic nitrogen atom of th cationic neutral sizing agent. More than 100 equivalents of the oxidizing agent can be used, although it is not preferable to use too much oxidizing agent because of pungent smell and corrosion of an apparatus. Preferably 2 – 50 equivalents, more preferably 5 – 30 equivalents of the oxidizing agent to the cationic nitrogen atom of the cationic neutral sizing agent is used.

When the amount of the oxidizing agent is too small, the sizing effect is sometimes too low as shown in the following examples.

In this specification, 1 equivalent of the oxidizing agent means the amount of the oxidizing agent which corresponds to the amount of a reducing agent containing 1 equivalent of hydrogen which participates to the reduction. For example, 1 mole of each of chlorine, sodium hypochlorite and ozone corresponds to 2 equivalents respectively and 1 mole of calcium hypochlorite [$Ca(OCl)_2$] corresponds to 4 equivalents.

It is not clear the reason why the sizing effect is improved by treating the mixture of the pulp slurry and the cationic neutral sizing agent with the oxidizing agent, however, it is considered to react the cationic nitrogen atom of the sizing agent with the oxidizing agent to lose solubility given by the cationic nitrogen atom.

In accordance with the method of the invention, enough sizing effect can be imparted even though an economical cationic neutral sizing agent is used in the paper making.

Moreover, the paper making is carried out in neutral condition whereby an alkaline material such as calcium carbonate can be used as filler. In the preferable feature of the present invention, an aqueous pulp slurry is prepared by the conventional method and then, the pulp slurry is admixed with a cationic neutral sizing agent of an acid salt of a diamine derivative of a copolymer formed by the reaction of a $C_{6-40}$ α-olefin-maleic anhydride copolymer with a diamine having at least one primary amino group, the molar ratio of the maleic anhydride to the α-olefin being 1 to 1.5:1; the average molecular weight of the α-olefine-maleic anhydride copolymer being 2,000 to 10,000 and the molar ratio of the diamine to the acid anhydride group of the α-olefin-maleic anhydride copolymer being 0.6 to 1.0:1.

In the mixture of the pulp slurry and the cationic neutral sizing agent, an amount of the cationic neutral sizing agent to the pulp in the slurry is in a range of 0.5 to 5 wt.% preferably 1 to 3 wt.%.

The sizing agent is not fixed on pulp. The purpose of the present invention is to fix the sizing agent to pulp after forming the uniform mixture of the pulp slurry and the cationic neutral sizing agent. The fixing of the sizing agent can be preferably attained by adding an oxidizing agent especially sodium hypochlorite or chlorine to the uniform mixture of the pulp slurry and the cationic neutral sizing agent, in a chest (large size tank equipped with a stirrer) or a diluting tank prior to paper making.

Am amount of the oxidizing agent for fixing the cationic neutral sizing agent is preferably 2 to 50 equivalents especially 5 to 30 equivalents to the cationic neutral sizing agent.

It is quite important feature to add the oxidizing agent after forming the uniform mixture of the pulp slurry and the cationic neutral sizing agent so as to uniformly fix the cationic neutral sizing agent to pulp. The pulps used in the invention can be ground pulp, refiner ground pulp, exploded pulp, sulfite pulp, sulfate pulp and the like.

The bleach of the pulp can be carried out by using chlorine or the other oxidizing agent.

It is necessary to remove such oxidizing agent before adding the cationic neutral sizing agent to the pulp slurry if it remains in the pulp slurry. Important feature of the present invention is to add oxidizing agent after forming the uniform mixture of the pulp slurry and the cationic neutral sizing agent.

The invention will be further illustrated by certain examples.

EXAMPLE 1

Preparation of cationic neutral sizing agent

In a flask, 319 g of α-olefin having 20 to 28 of carbon atoms (trade name: Dialen 208, manufactured by Mitsubishi Chemical Industries Ltd.) 78.4 g of maleic anhydride and 300 g of xylene were charged. The flask was purged with nitrogen gas and was heated to 90° C. A 3.87 g of benzoyl peroxide was added to the mixture with stirring and then the reaction was continued for 6 hours. After the reaction, xylene was stripped off by heating the reaction mixture and the unreacted α-olefin was removed in a reduced pressure to obtain 354 g of α-olefin-maleic anhydride copolymer which has a reduced viscosity of 0.095 dl/g (25° C in benzene).

In a 300 ml flask equipped with a reflux condenser and a water separator, 60 g of the α-olefin-maleic anhydride copolymer was charged and was uniformly dissolved in 60 g of xylene by heating in the reflux condition of xylene.

A 9.7 g of N,N-dimethylethylenediamine (which corresponded to 0.7 mole to the acid anhydride group of the copolymer) was added dropwise to the solution and the reaction was continued for 60 minutes.

The formed water was separated out of the flask to complete the reaction. The reaction product was an aminated copolymer which was treated with an acid or a quaternizing agent to obtain cationic neutral sizing agents. In the preparation of acid salt treated with the acid, xylene was completely removed from the reaction mixture in a reduced pressure and then the reaction product was added to an aqueous solution of acetic acid which was equivalent to the tertiary amino group of the aminated copolymer and was dissolved with stirring at 90° to 95° C for 120 minutes to obtain 25 wt.% of an aqueous solution of cationic neutral sizing agent.

In the preparation of quaternary ammonium salt treated with the quaternizing agent, the quaternizing agent was added dropwise to the reaction mixture in the reflux condition of xylene at a ratio of equivalent to the tertiary amino group during 30 minutes, and then the reaction was continued for 2 hours.

After the reaction, xylene was completely removed in a reduced pressure and the quaternary compound was dissolved in water with stirring to obtain the cationic neutral sizing agent.

When epichlorohydrin was used as quaternizing agent, the aminated copolymer was treated with hydrochloric acid to form an aqueous solution of hydrochloride thereof and epichlorohydrine was added to the solution and the reaction was carried out at 50° C for 2 hours to obtain the quaternary compound.

The resulting solution of the sizing agent was ununiformly emulsified and was opaque.

Paper making

A 1% aqueous pulp slurry (N/L = 1/1 BKP freeness 362 cc) was prepared by using a deionized water.

The cationic neutral sizing agent was added to the aqueous pulp slurry at a ratio of 1 wt.% to pulp. The mixture was diluted with a deionized water or a paper making water containing 2.5 ppm of sodium hypochlorite to 100 times.

The paper making was carried out with the diluted pulp slurry by TAPPI standard sheet machine, and the wet sheet was dried at 105° C for 3 minutes by a rotary type drum dryer to prepare paper having 60 g/m$^2$.

The types of the acid and quaternizing agents used in the preparation of the cationic neutral sizing agents and the sizing degrees are shown in Table 1.

Table 1

| | Results of sizing degree (seconds in Stockigt method) | |
|---|---|---|
| | Sizing degree (sec.) paper making water | |
| cationizing agent | deionized water | NaClO-containing water |
| ethylene-chlorohydrine | 0.7 | 20.4 |
| benzyl chloride | 0 | 1.5 |
| lauryl bromide | 0 | 0.7 |
| 2,3-dichloro-propanol-1 | 1.6 | 16.9 |
| epichloro-hydrine | 0.6 | 24.5 |
| acetic acid | 0 | 31.9 |

The stockigt method of determining sizing quality is described in "The Manufacture of Pulp and Paper", Volume V, 1925, Section 5, pages 25 and 26.

EXAMPLE 2

In accordance with the process of Example 1, the paper making was carried out by using a cationic neutral sizing agent prepared by using acetic acid as a cationizing agent.

A 1% aqueous pulp slurry (N/L = 1/1 BKP freeness 373 cc) was prepared by using a deionized water.

The cationic neutral sizing agent was added to the aqueous pulp slurry at a ratio of 1 wt.% to pulp.

The oxidizing agent was added to the pulp slurry. The mixture was diluted with a deionized water to 100 times. The paper making was carried out with the diluted pulp slurry by TAPPI standard sheet machine, and the wet sheet was dried at 105° C for 3 minutes by a rotary type drum dryer to prepare paper having 60 g/m$^2$.

The results are shown in Table 2.

Table 2

| oxidizing agent | Results of sizing degree (seconds in Stockigt method) Amount (ppm) | sizing degree (sec.) |
|---|---|---|
| — | — | 0.9 |
| NaOCl | 5.6 | 5.8 |
| " | 11.2 | 10.2 |
| " | 22.4 | 22.9 |
| " | 100 | 36.5 |
| $Cl_2$ | 50 | 36.5 |
| $Br_2$ | 50 | 33.8 |
| $I_2$ | 50 | 34.0 |
| $KMnO_4$ | 50 | 35.2 |

EXAMPLE 3

In accordance with the process of Example 1, the paper making was carried out by using a cationic neutral sizing agent prepared by using acetic acid as a cationizing agent or an uniform emulsion of a cationic neutral sizing agent prepared by further adding epichlorohydrin as a quaternizing agent in accordance with the process of Example 1. A 1% aqueous pulp slurry (N/L = 1/1 BKP freeness 402 cc) was prepared by using a deionized water and the cationic neutral sizing agent was added at a ratio of 1 wt.% to pulp.

The pulp slurry was diluted with a deionized water or a paper making water containing 2.5 ppm of sodium hypochlorite to 100 times. The paper making was carried out with the diluted pulp slurry by TAPPI standard sheet machine, and the wet sheet was dried at 105° C for 3 minutes by a rotary type drum dryer to prepare paper having 60 g/m².

The results are shown in Table 3.

Table 3

| cationizing agent | Results of sizing degree (seconds in Stockigt method) paper making water: deionized water | NaOCl-containing water |
|---|---|---|
| acetic acid | 0.6 | 33.3 |
| epichlorohydrine | 20.7 | 27.7 |

EXAMPLE 4

In accordance with the process of Example 1, the paper making was carried out by using a cationic neutral sizing agent prepared by using acetic acid as a cationizing agent to prepare a paper having calcium carbonate as a filler.

A 2% aqueous pulp slurry (N/L = 1/1 BKP freeness 350 cc) was prepared and admixed with 40 wt.% of calcium carbonate and 0.9 wt.% of the cationic neutral sizing agent (based on pulp). The mixture was diluted with an industrial water or a the industrial water containing 1.0 ppm of sodium hypochlorite to 200 times.

The paper making was carried out with the diluted pulp slurry by TAPPI standard sheet machine and the wet sheet was dried at 105° C for 3 minutes by a rotary type drum dryer to prepare paper having 70 g/m².

When the industrial water was used as the paper making water, the sizing degree was zero whereas when the industrial water containing sodium hypochlorite was used, the sizing degree was 29.6 seconds.

When the aqueous pulp slurry containing calcium carbonate and the cationic neutral sizing agent was admixed with sodium hypochlorite to be 200 ppm and the mixture was diluted with an industrial water to 200 times, and the paper making was carried out by using it, the sizing degree was 28.3 seconds.

EXAMPLE 5

In accordance with the process of Example 1, the paper making was carried out by using a cationic neutral sizing agent prepared by using acetic acid as a cationizing agent.

A 1% aqueous pulp slurry (N/L = 1/1 BKP freeness 373 cc) was prepared by using a deionized water.

The cationic neutral sizing agent was added to the aqueous pulp slurry at a ratio of 1 wt.% to pulp.

The pulp slurry was diluted with a deionized water or a subterranean water to 100 times.

The paper making was carried out with the diluted pulp slurry by TAPPI standard sheet machine, and the wet sheet which was immersed in 1% aqueous solution of sodium hypochlorite or which was not immersed was dried at 105° C for 3 minutes by a rotary type drum dryer to prepare paper having 60 g/m².

The results are shown in Table 4.

Table 4

| paper making water | Results of sizing degree (seconds in Stockigt method) NaClO-containing water-treatment | sizing degree (sec.) |
|---|---|---|
| subterranean water | none | 0.8 |
| " | treated | 33.1 |
| deionized water | none | 0.3 |
| " | treated | 32.6 |

EXAMPLE 6

Maleic petroleum resin (12% of maleic content) was reacted with N,N-dimethyl-1,3-propanediamine at a ratio of equivalent to the acid anhydride group of the resin and then acetic acid or epichlorohydrin was reacted with the product to prepare each cationic neutral sizing agent. A 1% aqueous pulp slurry (N/L = 1/1 BKP freeness 362 cc) was prepared by using a deionized water and the cationic neutral sizing agent was added to the aqueous pulp slurry at a ratio of 1 wt.% to pulp.

The mixture was diluted with a deionized water or a paper making water containing 2.5 ppm of sodium hypochlorite to 100 times.

The paper making was carried out in accordance with the process of Example 1.

The results are shown in Table 5.

Table 5

| cationizing agent | Results of sizing degree (seconds in Stockigt method) sizing degree (sec.) paper making water: deionized water | NaClO-containing water |
|---|---|---|
| acetic acid | 11.6 | 22.2 |
| epichlorohydrine | 17.7 | 27.6 |

EXAMPLE 7

A 1% aqueous pulp slurry (N/L = 1/1 BKP freeness 402 cc) was prepared by using a deionized water and the commercial cationic neutral sizing agents shown in Table 6 was added to the aqueous pulp slurry at a ratio of 1 wt.% to pulp.

The mixture was diluted with a deionized water or a paper making water containing 2.5 ppm of sodium hypochlorite to 100 times. The paper making was carried out in accordance with the process of Example 1.

The results are shown in Table 6.

Table 6

| sizing agent (tradename) | | Results of sizing degree (seconds in Stockigt method) sizing degree (sec.) paper making water: deionized water | NaClO-containing water |
|---|---|---|---|
| Koropal N | *1 | 24.4 | 30.9 |
| Polimaron 360 | *2 | 15.4 | 23.0 |
| Sansizer SC101 | *3 | 2.3 | 29.2 |
| Aporon N | *4 | 20.3 | 23.5 |
| Basoplast 280 D | *5 | 2.3 | 29.1 |
| Homo-7 | *6 | 19.4 | 27.7 |

*1: manufactured by Seiko Kagaku Kogyo K.K.
*2: manufactured by Arakawa Rinsan Kagaku Kogyo K.K.
*3: manufactured by Sanyo Kasei Kogyo K.K.
*4: manufactured by Hamano Industry Co., Ltd.
*5: manufactured by BASF
*6: manufactured by Kindai Kagaku Kogyo K.K.

EXAMPLE 8

A 1% aqueous pulp slurry (N/L = 1/1 BKP freeness 373 cc) was prepared by using a deionized water and the sizing agent Homo-7 was added to it at a ratio of 1 wt.% to pulp.

The mixture, with or without adding sodium hypochlorite at a concentration of 50 ppm, was diluted with a deionized water to 100 times. The paper making was carried out in accordance with the process of Example 1.

The sizing degree was improved by adding sodium hypochlorite from 16.5 seconds to 23.7 seconds.

We claim:

1. A method of making sized paper which is characterized by the steps of the preparation of a pulp slurry in a beater, addition of water soluble or water dispersible polymeric cationic neutral sizing agent having cationic nitrogen atoms, forming the pulp into a wet sheet and drying of the wet sheet, wherein the improvement comprises treating aqueous pulp slurry containing the cationic neutral sizing agent, or the wet sheet prepared therefrom, with an oxidizing agent, the oxidizing agent having the ability to and being used in amount to fix the cationic neutral sizing agent on the pulp.

2. A method as described in claim 1, wherein 1–100 equivalents of oxidizing agent per 1 equivalent of cationic nitrogen atom of the cationic neutral sizing agent is used.

3. A method as described in claim 2, wherein the cationic neutral sizing agent comprises an acid salt of a diamine derivative of a copolymer formed by the reaction of a $C_{6-40}\alpha$-olefin-maleic anhydride copolymer with a diamine having at least one primary amino group.

4. A method as described in claim 2, wherein the cationic neutral sizing agent comprises a quaternary ammonium salt of a diamine derivative of a copolymer formed by the reaction of $C_{6-40}\alpha$-olefin-maleic anhydride copolymer with a diamine having at least one primary amino group.

5. A method as described in claim 2, wherein the oxidizing agent is at least one member selected from the group consisting of halogen, oxyacids of halogen, salts of oxyacids of halogen, potassium permanganate, potassium bichromate and ozone.

6. A method as described in claim 5, wherein the oxidizing agent is chlorine, bromine or iodine.

7. A method as described in claim 5, wherein the oxidizing agent is sodium hypochlorite.

8. A method as described in claim 2, wherein the pulp slurry is treated with an aqueous solution containing the oxidizing agent.

9. A method as described in claim 2, wherein the wet sheet is treated with an aqueous solution or a gas containing the oxidizing agent.

10. A method for making a sized paper which comprises (a) adding to an aqueous pulp slurry, a cationic neutral sizing agent comprising an acid salt of a diamine derivative of a copolymer formed by the reaction of $C_{6-40}\alpha$-olefin-maleic anhydride copolymer with a diamine having at least one primary amino group, the molar ratio of the maleic anhydride to the $\alpha$-olefin being 1–1.5:1, the average molecular weight of the $\alpha$-olefin/maleic anhydride copolymer being 2000–10,000, and the molar ratio of the diamine to the acid anhydride group of the $\alpha$-olefin-maleic anhydride copolymer being 0.6–1.0:1.0, (b) adding an oxidizing agent to the pulp slurry containing the cationic neutral sizing agent, and (c) forming the thus treated pulp slurry into a paper, the oxidizing agent having the ability to and being used in an amount to fix the cationic neutral sizing agent to the pulp.

11. A method as described in claim 10, wherein 1–100 equivalents of the oxidizing agent per 1 equivalent of a cationic nitrogen atom of the cationic neutral sizing agent is used.

12. A method as described in claim 11, wherein the acid is acetic acid.

13. A method as described in claim 11, wherein the $\alpha$-olefin is a mixture of $\alpha$-olefins having 20 – 28 carbon atoms.

14. A method as described in claim 11, wherein the diamine is an aliphatic diamine having 2 – 6 alkylene group, and one primary and one tertiary amino group.

15. A method as described in claim 14, wherein the diamine is N,N-dimethylethylenediamine or N,N-dimethyl-1,3-propanediamine.

16. A method as described in claim 11, wherein the oxidizing agent is chlorine.

17. A method as described in claim 11, wherein the oxidizing agent is sodium hypochlorite.

* * * * *